United States Patent [19]

Gennep

[11] Patent Number: 5,063,796

[45] **Date of Patent: * Nov. 12, 1991**

[54] TOOL DRIVER WITH A HANDLE

[76] Inventor: Jan V. Gennep, 715 Laurel Ave., Menlo Park, Calif. 94025

[ * ] Notice: The portion of the term of this patent subsequent to May 1, 2007 has been disclaimed.

[21] Appl. No.: 502,569

[22] Filed: Mar. 30, 1990

Related U.S. Application Data

[63] Continuation-in-part of Ser. No. 274,925, Dec. 22, 1988, Pat. No. 4,920,832.

[51] Int. Cl.[5] ..... B25B 17/00

[52] U.S. Cl. ..... 81/57.29; 81/177.4; 362/120

[58] Field of Search ..... 81/57.29, 58.1, 177.4, 81/438, 490; 362/119, 120

[56] References Cited

U.S. PATENT DOCUMENTS

| | | | |
|---|---|---|---|
| 719,275 | 1/1903 | Swan | 81/490 |
| 1,299,591 | 4/1919 | Malchow | 87/57.29 |
| 2,284,871 | 6/1942 | Huss | 81/57.29 |
| 2,696,859 | 12/1954 | Somma | 87/57.29 |
| 3,214,992 | 11/1965 | Dietrich | 81/57.29 X |
| 3,532,012 | 10/1970 | Pryor | 87/57.29 |
| 3,603,782 | 9/1971 | Wortmann | 362/120 |
| 4,455,896 | 6/1984 | Holmes | 87/57.26 |
| 4,643,052 | 2/1987 | Badiali | 81/438 X |
| 4,722,035 | 1/1988 | Rapisarda | 362/119 X |
| 4,827,812 | 5/1989 | Markovetz | 81/490 X |

FOREIGN PATENT DOCUMENTS

| | | | |
|---|---|---|---|
| 681319 | 10/1952 | United Kingdom | 81/177.4 |

*Primary Examiner*—James G. Smith

*Attorney, Agent, or Firm*—Flehr, Hohbach, Test, Albritton & Herbert

[57] ABSTRACT

A tool driver with a handle for loosening and tightening fasteners or drilling holes in hard-to-reach locations. The tool driver contains a direct drive shaft and a mechanical means for converting force applied to the direct drive shaft to motion of a transverse tool attachment. A second tool attachment is located at one end of the direct drive shaft permitting a tool to be directly driven. A handle is provided for stabilizing and controlling the tool driver, as well as securing and containing extra tools. Alternatively, the handle is a container for batteries used to power a luminous element which illuminates the workpiece.

35 Claims, 2 Drawing Sheets

TOOL DRIVER WITH A HANDLE

CROSS REFERENCE TO RELATED APPLICATIONS

This application is a continuation-in-part of Pat. application Ser. No. 274.925 filed Nov. 22, 1988 for a Tool Driver, now U.S. Pat. No. 4,920,832.

The invention relates to a device for use with a rotary driver to facilitate use of same for driving tools relative to workpieces. More particularly, this invention relates to such a driving device having a handle that is an integral container.

BACKGROUND OF THE INVENTION

Fasteners located in hard-to-reach locations are typically tightened or loosened using either a universal joint intermediary device, or via a mechanic's hands for lack of a better tool. However, a universal joint is only useful where the angle formed between the driver and the fastener is shallow, while hands are only useful to apply a small amount of torque. Moreover, in many situations a hand is too large to grasp a fastener in a restricted location. More recently a tool driver, patent U.S. Pat. No. 4,920,832, was developed as a solution to the aforementioned problems.

The tool driver described in such application is an intermediary device which is driven by a rotary driver, such as a socket wrench or drill. The device translates the torque supplied by the driver to a transversely attached tool. A number of tool types may be used. For example, the tool could be a socket to interact with a nut or it could be a screwdriver bit.

The tool driver is a superb device for tightening and loosening hard to reach fasteners. However, at times a large amount of force must be applied along the tool and fastener rotational axis to initiate tightening or loosening. It also has been found that aligning a fastener or drill bit can be difficult when the desired location is restricted or partially hidden from view.

Currently tools used with the tool driver are carried separate from the tool driver. This results in lost tools and an increased amount of time to exchange tools In many instances, using a tool at hard-to-reach locations requires a means to attach a fastener for such a location to the tool prior to tightening. Additionally, a means for holding a fastener to the tool after loosening and removal is helpful. The tool driver described in the above application does not have either of these qualities.

Typically, the hard-to-reach locations are not illuminated very well. Consequently, artificial lighting must be provided by the mechanic. In close quarters, this can be a difficult task. A means for providing illumination of the work piece, where the luminous element is attached to the tool driver, is helpful. The tool driver described in the above application does not have this attribute.

SUMMARY OF THE INVENTION

In order to improve the above-discussed tool driver, the present invention incorporates apparatus for stabilizing and controlling the tool driver, as well as securing and containing extra tools. The tool driver includes a direct drive shaft and a mechanical means for converting force applied to the direct drive shaft to motion of a transverse tool attachment. Preferably, a second tool attachment is located at one end of the direct drive shaft permitting a tool to be directly driven. Each tool attachment desirably is designed to enable a variety of tools to be used and easily interchanged with other tools.

In keeping with one aspect of the invention, the device also includes a handle attached to the tool driver enabling the user to apply pressure along the device's driving axis and subsequently upon the tool along such axis. The handle also provides stability while driving and aids in tool alignment. Preferably, the handle is constructed to aid gripping and is separable from the tool body to facilitate the tool driver's use in close quarters.

In accordance with another aspect of the invention, a container is provided for tools to be used with the tool attachment. Most simply, the handle provides such container. Thus, one part has a dual function—it acts as a handle to facilitate use of the driver and as a container within which tools are kept. Preferably, the tools are secured to the tool driver body by a magnet, and the handle is hollow and placed over the tools forming a protective container. In addition, the magnet is positioned to magnetize any tool at the attachment means enabling such tool to "hold" fasteners prior to tightening and after loosening.

In keeping with another aspect of the invention, a container is provided for batteries used to power a luminous element. Most simply, the handle provides such container. Preferably, the luminous element is attached to the tool driver in a location that provides illumination of the workpieces associated with both the directly and indirectly driven tools.

BRIEF DESCRIPTION OF THE DRAWINGS

Additional objects and features of the invention will be more apparent from the following detailed description and appended claims when taken in conjunction with the drawings, in which:

DESCRIPTION OF THE PREFERRED EMBODIMENT

Figure 1:
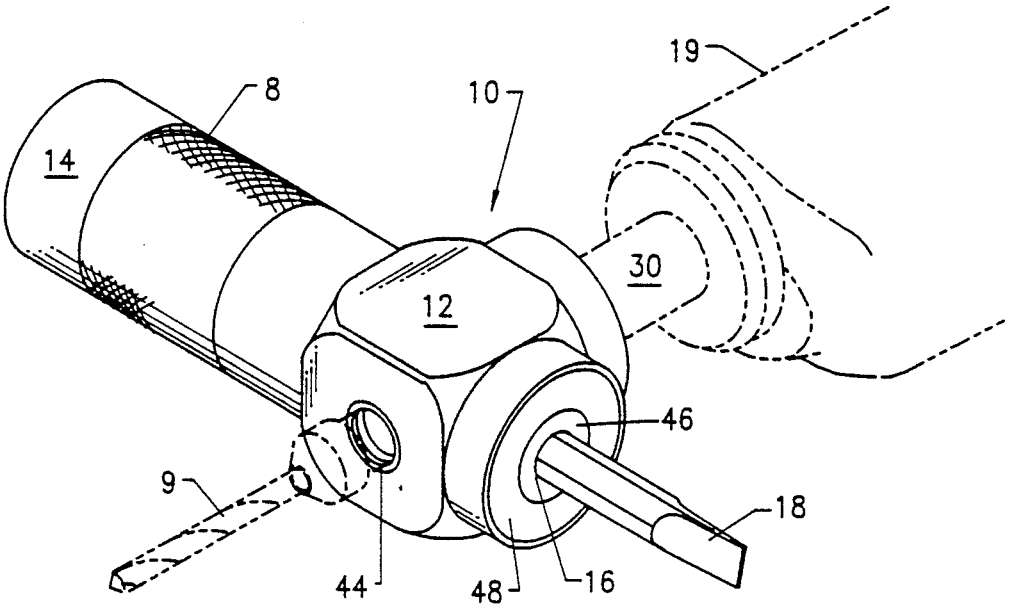
FIG. 1 an isometric view illustrating a tool driver in accordance with the present invention, in combination with a rotary driver.

Referring to FIG. 1, there is shown a preferred embodiment of the tool driver apparatus 10 of the present invention. It includes mechanical means (not shown in FIG. 1) enclosed in a housing 12 for translating force, a handle 14, and apparatus 16 for attaching a tool 18 transverse to the driving implement represented at 19. Additionally, apparatus 44 for attaching a tool 9 generally axially relative to the driving implement 19.

Figure 2:
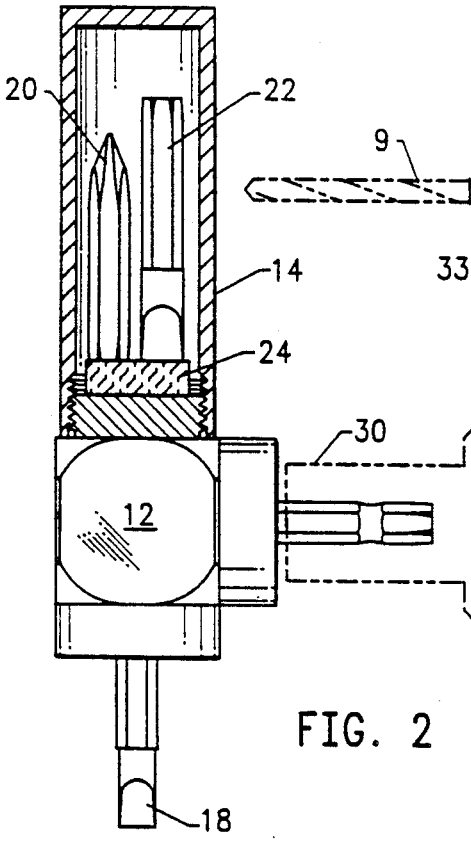
FIG. 2 is a side view of the tool driver of FIG. 1 with a cross-sectional view of the handle dually functioning as a container for tools.

In the preferred embodiment, the handle 14 is attached to the housing 12 opposite the indirectly driven tool 18 to provide stability, leverage, and easy tool alignment during operation. The handle includes a means for gripping. Such means take the form of a knurled surface 8. However, such means may also be accomplished by conforming the surface to better fit into the palm of a hand. Additionally, the handle 14 is constructed to be separable from the tool driver housing 12. FIG. 2 depicts the handle 14 as attached by threads allowing easy removal when it is necessary to fit the tool driver 10 into close quarters. Moreover, the handle 14 is preferably a hollow right circular cylinder constructed of a non-magnetic material such as aluminum.

The hollow, removable handle 14 has a second function as a container enclosing the tools 20, 22 not currently in use. Thus, stored tools 20, 22 are less likely to be misplaced or lost.

The preferred embodiment incorporates a means for securing the tools 20, 22 to inhibit rattling of the tools when they are stored in the container 14 and to simplify selection of a desired tool from a plurality of stored tools. Such means take the form of one or more magnets 24 which are attached to the housing 12. Such attachment means may also take the form of a clamping mechanism that secures each extra tool to the housing 12. Securing the tools 20, 22 alleviates the problem of carrying the tools in a separate storage facility and reduces the risk of misplacing them. In the preferred embodiment, the handle 14 is used as a protective cover over the magnetically secured tools 20, 22.

The preferred embodiment of the invention includes a means for holding a fastener to the tool 18. It is often desirable to do so prior to the tightening and after the loosening of a fastener. Such means takes the form of a magnet 24 positioned in a bore 25 in the housing 12. Note the same magnet 24 also secures the stored tools within the container. More than one magnet may be used to provide a greater magnetic force for holding the tools 20, 22. The proximity of the magnet 25 to the housing 12 magnetizes the entire housing 12 and the attached tool 18. Any fastener constructed from magnetic materials will be held to the magnetized tool 18 prior to fastening, as well as after loosening. Holding a fastener as described aids fastener alignment and reduces the risk of losing fasteners.

Figure 3:
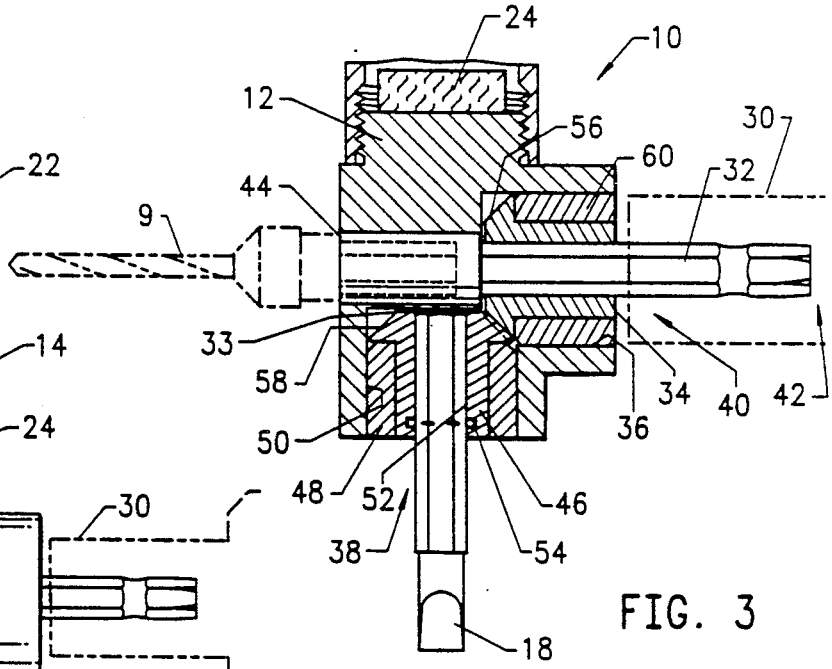
FIG. 3 is a cross-sectional view of the tool driver of FIG. 1.

The preferred embodiment of the tool driver 10, as shown in the section view of FIG. 3, has a housing 12 enclosing an indirect driving portion 38 and a direct drive portion 40. The housing 12 protects the users hands from the harm that could be inflicted by the meshing gears of the force converting mechanism and provides a means for holding the gears together. Although from the broad standpoint the driving mechanism could be designed to translate force of any kind to transverse motion, in this preferred embodiment it converts torque to transverse rotary motion. To this end, the direct driving portion 40 includes a direct drive shaft 32 extending through the housing 12, which is integral with the first bevel gear 34. The direct drive shaft 32 includes a rotary drive receiving end 42, adapted to connect a rotary driver such as a drill or ratchet wrench, and a tool connector end 44, adapted to receive a tool to tighten/loosen fasteners or drill holes. Connector 44 is disposed within the housing 12.

The first bevel gear 34 is positioned in bore 36. The bevel gear 34 is held in place by a needle bearing assembly 60 which is press fit into the bore 36. The direct drive shaft 32 is integrally coupled to the bevel gear 34 such that when the shaft 32 is rotated, the first bevel gear 34 also rotates. Preferably, the direct drive shaft 32 is a standard hex drive bit holder. However, the direct drive shaft 32 is removable so that other types of shafts with varying types of tool connector ends 44 may be used. For instance, the hex drive bit holder 32 could be replaced with a shaft that has a threaded bit holder end providing a more stable tool holder than the hex bit holder. Stability of the bit holder is of paramount importance in some drilling applications.

The indirect driving portion 38 includes a second bevel gear 46, where the bevel gear 46 is held in place by a needle bearing assembly 48. The needle bearing assembly 48 is press fit into a bore 50 in the housing 12. The second bevel gear 46 includes an integral tool connector 52 and a locking ring 54 to hold the tool 18 in place. The tool 18 extends through the second bevel gear 46 and protrudes from the second bevel gear 46 forming a pivot at the housing 12. This configuration maintains a small space 33 between the second bevel gear 46 and the housing 12 such that the bevel gear 46 will not destroy the housing 12 through friction. Preferably, the tool connecter 52 is a hex bit holder. However, a threaded bit holder can also be fashioned as an integral portion of the second bevel gear 46. The threaded bits do not protrude from the second bevel gear due to manufacturing standards for the bit holders. To provide a low friction pivot, a ball bearing is positioned at the pivot of the second bevel gear 46 to maintain the space between the bevel gear 46 and the housing 12.

Both bevel gears 34, 46 and their associated needle bearings 60, 48 are positioned in the housing 12 such that the teeth 56 of the first bevel gear 34 mesh with the teeth 58 of the second bevel gear 46. Thus, when the first bevel gear 34 is rotated via the direct drive shaft 32, the second bevel gear 46 will also rotate and vice versa.

Figure 4:
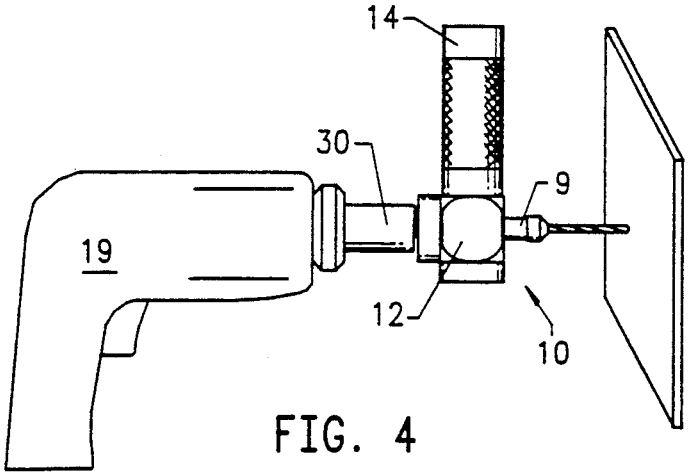
FIG. 4 is a side view of the tool driver of FIG. 1 depicted operating with a drill as a rotary driver and a drill bit as a directly driven tool.
Figure 5:
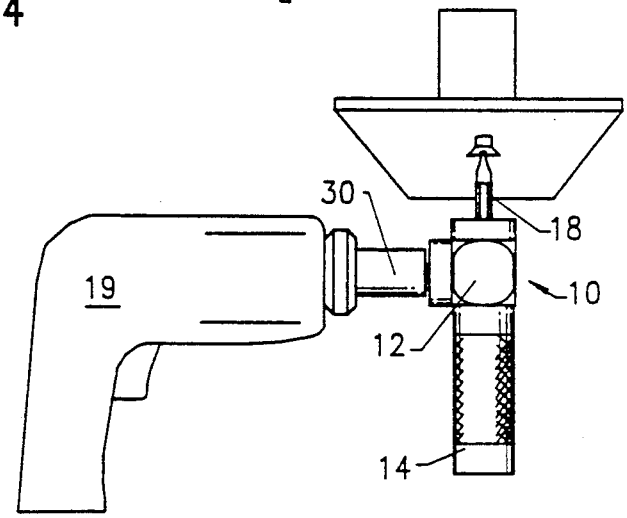
FIG. 5 is a side view of the tool driver of FIG. 1 depicted operating with a drill as a rotary driver and a screwdriver bit as an indirectly driven tool.

In operation, either the directly driven tool 9, as illustrated in FIG. 4, or the indirectly driven tool 18, as illustrated in FIG. 5, may be used to tighten or loosen fasteners or drill holes. In either case, a rotary driver 19, such as a drill or a socket wrench, is attached to the direct drive shaft 32. The applied torque will be transferred either to a tool mounted in the direct drive tool connector 44 or the indirect drive tool connector 52. The driving element's direction of motion is transferred to the indirect tool by means of the meshing bevel gears 34 and 46. A tool mounted in either position will rotate and facilitate tightening or loosening fasteners or drilling holes. In some instances, it may be desirable to attach both indirect 18 and direct 9 tools at the same time as depicted in FIG. 1.

The preferred embodiment can be used to drive various types of fasteners. For example, the invention can be used to tighten or loosen nuts, bolts, screws, and the like. In addition, a drill bit can be inserted into either tool connector 52 or 44 enabling holes to be drilled indirectly or directly. Furthermore, enhanced versatility is achieved by using the tool driver in conjunction with snakes or universal joints. In other words, the tool driver can be employed in any application in which a device is driven or rotated.

Figure 6:
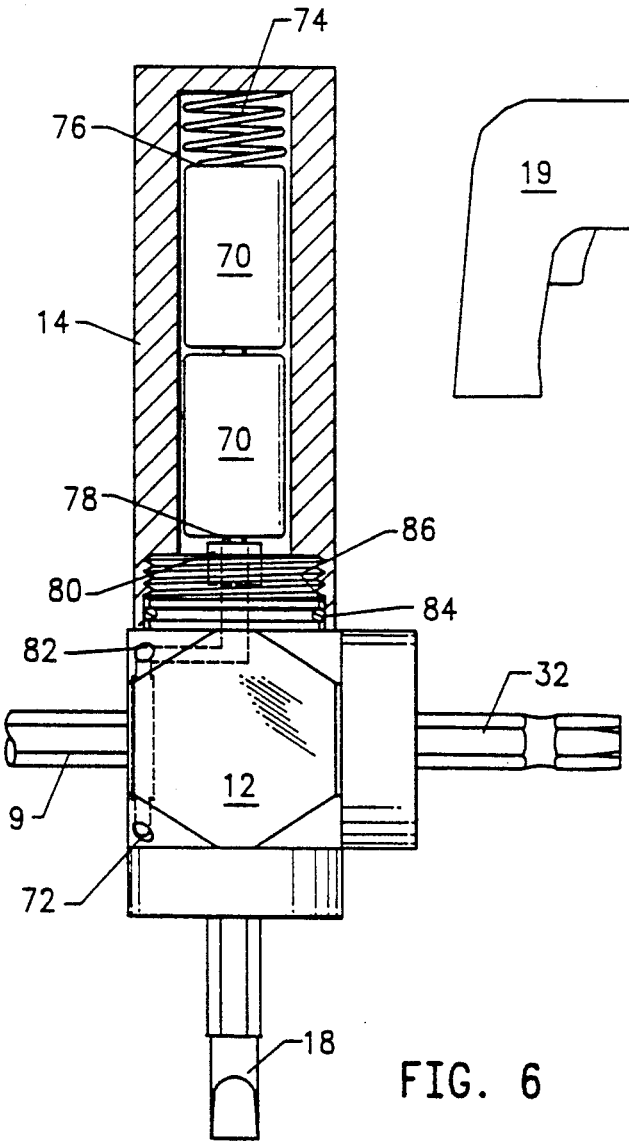
FIG. 6 is a side view of the tool driver of FIG. 1 with a cross-sectional view of the handle dually functioning as a container for batteries.

FIG. 6 illustrates another embodiment of the invention. Here, the handle 14 is used as a container for batteries 70. The batteries 70 are used to power a means for illuminating the workpiece. Such means are accomplished by a light emitting diode. Such means for illuminating are also accomplished by an incandescent light bulb. In the preferred embodiment, a light emitting diode 72 is positioned on the housing 12 such that the work pieces associated with either the direct 9 or indirect 18 tool would be illuminated. The negative terminal 76 of the battery pair 70 is connected to the handle 14 via a spring 74. The spring 74 provides pressure to the batteries 70 maintaining contact between the positive battery terminal 78 and the electrical connector 80. A wire (not shown) is routed from the positive battery terminal electrical connector 80 through a bore 82 in the housing to the light emitting diode 72.

The spring 74 is designed to only maintain pressure on the batteries 70 while the handle 14 is fully tightened to the housing 12. Consequently, the light emitting diode 72 is luminous only when the handle 14 is fully tightened. When the handle 14 is loosened enough to alleviate the spring's 74 pressure upon the batteries 70, the electrical circuit is broken and the light emitting diode 72 will cease being luminous. A rubber 0-ring 84 is positioned to maintain pressure on the inner circumference 86 of the handle 14 ensuring that in its loosened state the handle 14 will not loosen further from operational vibration.

While the present invention has been described with reference to a few embodiments, the description is illustrative of the invention and is not to be construed as limiting the invention. Various modifications may occur to those skilled in the art without departing from the true spirit and scope of the invention as defined by the claims.

What is claimed is:

1. A device for driving tools, comprising:
a direct drive shaft enabling attachment of a driving implement to the device;
means for attaching a tool transverse to said drive shaft;
means for converting driving force applied to said direct drive shaft to movement of said attachment means on a driving axis transverse to said direct drive shaft;
a housing encasing the force converting means;
said means for converting driving force including a first bevel gear rotatably mounted in said housing and attached to said direct drive shaft and a second bevel gear meshing in said housing with said first bevel gear and rotatably mounted therein by a bearing, said second bevel gear being attached to said means for attaching a tool transverse to said drive shaft, and said bearing supporting said second bevel gear spaced from said housing; and
a handle attached to said housing and facilitating operation of a tool at said attachment means.

2. The device of claim 1 wherein said handle is located generally coaxial with said driving axis to facilitate manual control of a tool at said attachment means.

3. The device of claim 2 wherein said handle is attached to said housing opposite to the point of attachment of a tool to said attachment means.

4. The device of claim 1 further including means for attaching a tool generally axially relative to said direct drive shaft.

5. The device of claim 1 wherein said handle is hollow for containing tools to be used with said attachment means.

6. The device of claim 1 wherein said means for converting force is adapted to convert torque to rotary motion.

7. The device of claim 1 wherein said handle includes a surface configuration to facilitate gripping.

8. The device of claim 7 wherein said handle has a textured surface.

9. The device of claim 1 wherein said handle is separable from the remainder of said device.

10. The device of claim 9 further including threads at the base of said handle to facilitate attachment to matching threads located at the desired point of attachment on said housing.

11. A device for driving tools, comprising:
a direct drive shaft enabling attachment of a driving implement to the device;
means for attaching a tool transverse to said drive shaft;
means for converting driving force applied to the direct drive shaft to movement of said attachment means on a driving axis transverse to said direct drive shaft;
a housing encasing the force converting means;
said means for converting driving force including a first bevel gear rotatably mounted in said housing and attached to said direct drive shaft and a second bevel gear meshing in said housing with said first bevel gear and rotatably mounted therein by a bearing, said second bevel gear being attached to said means for attaching a tool transverse to said drive shaft, and said bearing supporting said second bevel gear spaced from said housing.

12. The device of claim 11 also including means for attaching a tool generally axially relative to said direct drive shaft.

13. The device of claim 12 wherein said means for converting force is adapted to convert torque to rotary motion.

14. The device of claim 13 further including a means for illuminating a workpiece.

15. The device of claim 14 wherein said illuminating means is a light emitting diode.

16. The device of claim 14 wherein said illuminating means is positioned on said housing between said means for attaching a tool generally axially relative to said direct drive shaft and said means for attaching a tool transverse to said drive shaft.

17. The device of claim 14 further including a container attached to said housing for enclosing batteries to be used with said illuminating means.

18. The device of claim 11 further including a container attached to said housing for enclosing tools to be used with said attachment means.

19. The device of claim 17 or 18 wherein said container is a handle which is generally coaxial with said driving axis.

20. The device of claim 18 further including a magnet within said container for holding tools relatively stationary.

21. The device of claim 17 or 18 wherein said container is separable from the remainder of the said device.

22. The device of claim 17 or 18, wherein said container includes threads at its base to facilitate attachment to matching threads located at the desired point of attachment on said housing.

23. The device of claim 17 or 18 wherein said container is attached to said housing opposite to the point of attachment of the tool.

24. The device of claim 17 or 18 wherein said container is adapted to have a surface configuration to facilitate gripping.

25. The device of claim 24 wherein said container is adapted to have a textured surface.

26. A device for driving tools, comprising:

a direct drive shaft enabling attachment of a driving instrument to the device;

means for attaching a tool generally axially relative to said shaft;

means for attaching a tool transverse to said drive shaft;

means for converting driving force applied to the direct drive shaft to movement of said attachment means on a driving axis transverse to said direct drive shaft;

a housing encasing the force converting means;

said means for converting driving force including a first bevel gear rotatably mounted in said housing and attached to said direct drive shaft and a second bevel gear meshing in said housing with said first bevel gear and rotatably mounted therein by a bearing, said second bevel gear being attached to said means for attaching a tool transverse to said drive shaft, and said bearing supporting said second bevel gear spaced from said housing; and means attached to said housing for holding tools to be used with said attachment means.

27. The device of claim 26 including means for attaching a tool generally axially relative to said direct drive shaft.

28. The device of claim 27 wherein said means for converting force is adapted to translate torque to rotary motion.

29. The device of claim 26 wherein said means for holding tools is a magnet.

30. The device of claim 29 wherein said magnet is a permanent magnet positioned to magnetize a tool at said attachment means.

31. The device of claim 26 wherein said means for holding tools is within a container for such tools.

32. The device of claim 31 wherein said container is a handle.

33. A device for driving tools, comprising:

a direct drive shaft enabling attachment of a driving implement to the device;

means for attaching a tool generally axially relative to said shaft;

means for attaching a tool transverse to said drive shaft;

means for converting driving force applied to the direct drive shaft to movement of said attachment means on a driving axis transverse to said direct drive shaft;

a housing encasing the force converting means;

said means for converting driving force including a first bevel gear rotatably mounted in said housing and attached to said direct drive shaft and a second bevel gear meshing in said housing with said first bevel gear and rotatably mounted therein by a bearing, said second bevel gear being attached to said means for attaching a tool transverse to said drive shaft, and said bearing supporting said second bevel gear spaced from said housing;

a magnet for holding tools to be used with said attachment means; and a hollow handle facilitating operation of a tool at said attachment means and being a container for tools.

34. A device for driving tools, comprising:

a direct drive shaft enabling attachment of a rotary driving implement to the device;

means for attaching a tool generally axially relative to said direct drive shaft;

means for attaching a tool transverse to said direct drive shaft;

means for converting rotary driving force applied to said direct drive shaft to rotary motion of said attachment means on a driving axis transverse to said direct drive shaft;

a housing encasing the force converting means;

said means for converting driving force including a first bevel gear rotatably mounted in said housing and attached to said direct drive shaft and a second bevel gear meshing in said housing with said first bevel gear and rotatably mounted therein by a bearing, said second bevel gear being attached to said means for attaching a tool transverse to said drive shaft, and said bearing supporting said second bevel gear spaced from said housing; and a handle attached to said housing and located generally coaxial with said driving axis facilitating manual control of a tool at said attachment means.

35. A device for driving tools, comprising:

a direct drive shaft enabling attachment of a driving implement to the device;

means for attaching a tool generally axially relative to said shaft;

means for converting driving force applied to the direct drive shaft to movement of said attachment means on a driving axis transverse to said direct drive shaft;

a housing encasing said means for converting driving force;

said means for converting driving force including a first bevel gear rotatably mounted in said housing and attached to said direct drive shaft and a second bevel gear meshing in said housing with said first bevel gear and rotatably mounted therein by a bearing, said second bevel gear being attached to said means for attaching a tool transverse to said drive shaft, and said bearing supporting said second bevel gear spaced from said housing;

a magnet for holding tools to be used with said attachment means; and a hollow handle facilitating operation of a tool at said attachment means and being a container for batteries used to power a luminous element attached to said housing between said means for attaching a tool transverse to said drive means and said means for attaching a tool generally axially relative to said direct drive shaft.

* * * * *